US009752775B2

(12) United States Patent
Embury

(10) Patent No.: US 9,752,775 B2
(45) Date of Patent: Sep. 5, 2017

(54) HEAT DISPERSING ELEMENT

(71) Applicant: Jody Embury, Durand, MI (US)

(72) Inventor: Jody Embury, Durand, MI (US)

( * ) Notice: Subject to any disclaimer, the term of this patent is extended or adjusted under 35 U.S.C. 154(b) by 0 days.

(21) Appl. No.: 15/064,680

(22) Filed: Mar. 9, 2016

(65) Prior Publication Data

US 2016/0186991 A1 Jun. 30, 2016

Related U.S. Application Data

(63) Continuation of application No. 14/035,205, filed on Sep. 24, 2013.

(51) Int. Cl.

| | |
|---|---|
| ***F23D 14/14*** | (2006.01) |
| ***F24H 3/00*** | (2006.01) |
| ***F23D 14/38*** | (2006.01) |
| ***F23D 14/46*** | (2006.01) |
| ***F23D 14/70*** | (2006.01) |
| ***F23D 14/76*** | (2006.01) |
| ***F23D 14/84*** | (2006.01) |
| ***F23D 14/28*** | (2006.01) |

(52) U.S. Cl.

CPC ..... *F23D 14/14* (2013.01); *F23D 14/28* (2013.01); *F23D 14/38* (2013.01); *F23D 14/465* (2013.01); *F23D 14/70* (2013.01); *F23D 14/76* (2013.01); *F23D 14/84* (2013.01); *F24H 3/006* (2013.01)

(58) Field of Classification Search

CPC ..... F23D 14/14; F23D 14/38
USPC ..... 126/92 AC
See application file for complete search history.

(56) References Cited

U.S. PATENT DOCUMENTS 1,733,615 A * 10/1929 McCabe ..... G05D 23/27537 236/9 R
3,139,879 A * 7/1964 Bauer ..... F23D 14/12 126/38
3,179,156 A * 4/1965 Gerhart ..... F23C 99/00 126/92 B
3,229,680 A * 1/1966 Hebert ..... F23D 14/18 126/92 B
3,245,459 A * 4/1966 Keith ..... F23D 14/18 431/268
3,330,267 A * 7/1967 Bauer ..... F23C 99/00 126/92 B
3,733,170 A * 5/1973 Kobayashi ..... F23D 14/145 431/329
3,814,573 A * 6/1974 Karlovetz ..... F23D 14/145 431/329
3,857,670 A * 12/1974 Karlovetz ..... D06F 67/02 431/329
3,941,116 A * 3/1976 Placek ..... F24C 3/14 126/92 B
5,237,912 A * 8/1993 Fins ..... A47J 33/00 126/41 R
6,843,649 B2 * 1/2005 Hart ..... A47J 37/0713 431/126

(Continued)

*Primary Examiner* — Avinash Savani
*Assistant Examiner* — Deepak Deean
(74) *Attorney, Agent, or Firm* — Lorenz & Kopf LLP

(57) ABSTRACT

A heat dispersing element for a standard propane torch head for the generation of silent heat. This heat dispersing element attaches directly to the head of a propane torch and operates silently. The heat dispersing element accepts the heat of the torch and silently disperses the heat through the burn plate and directs it outward silently. This is done through a series of openings.

18 Claims, 3 Drawing Sheets

(56) References Cited

U.S. PATENT DOCUMENTS

2005/0175950 A1* 8/2005 Waters ..... F24C 1/12
432/209
2013/0287375 A1* 10/2013 Hall, Jr. ..... F24D 19/1096
392/407

* cited by examiner

HEAT DISPERSING ELEMENT

This application is a continuation-in-part application of U.S. Ser. No. 14/035,205, filed Sep. 24, 2013, pending, from which priority is claimed.

SUMMARY OF THE INVENTION

The applicant is unaware of any prior art concerning the present device. The heat dispersing element attaches to a standard propane torch head to produce noiseless heat generation. There are many portable propane heaters available as heaters. However, there are not any heat dispersing elements that are attachable to a standard propane torch head that provide noiseless heat.

THE INVENTION

This heat dispersing element attaches directly to the head of a propane torch and operates silently. The heat dispersing element accepts the heat of the torch and silently disperses the heat through the burn plate and directs it outward silently. This is done through a series of openings.

Thus, the present invention is a metal heat dispersing element that attaches to a propane fuel tank and prevents noise or light while the fuel tank is operating. The metal heat dispersing unit is comprised of a main housing comprising a flat top, a flat bottom, a front, a back and two side panels, wherein the back is shorter in length than the front. The front has an inside flat surface. The front has a multiplicity of small through holes therein.

The back has a first single through hole therein centered in the back. The single through hole has fixedly surmounted thereover a segment of metal stock that has a second single through hole. The first single through hole and the second single through hole are aligned with each other. The second through hole is internally threaded.

The segment of metal stock that has an internally threaded second opening in a side is to accommodate a set screw.

There is a single metal plate that has a series of small through holes therein wherein the through holes are less in number than the number of through holes in the front.

The single plate has two ends. The single plate is bent in the center thereof between the two ends such that the center is out of line with the two ends.

The single plate is fixedly attached by the ends to the inside surface of the front such that the out of line portion extends towards the back of the main housing.

DETAILED DESCRIPTION

Figure 1:
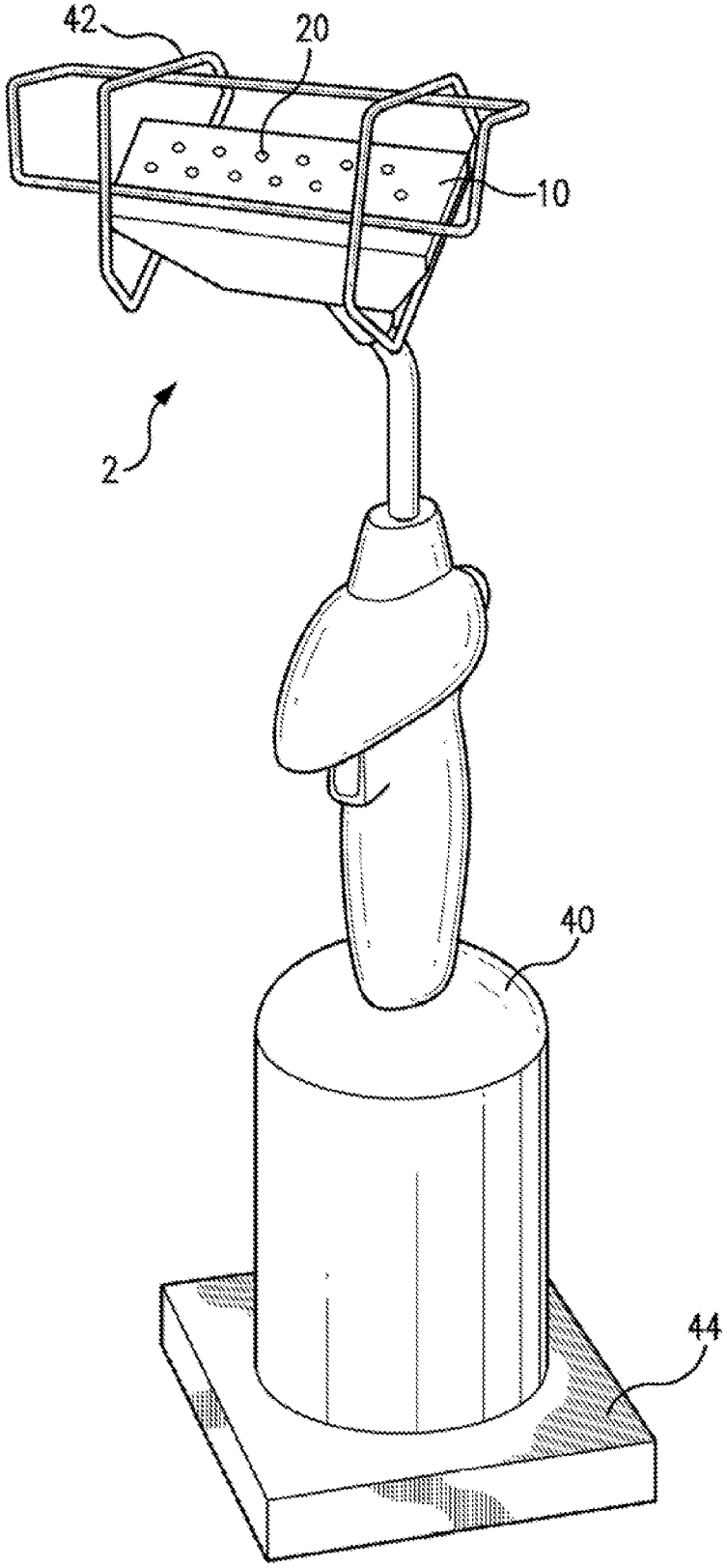
FIG. 1 shows the metal heat dispersing element secured to a propane torch.

FIG. 1 shows the heat dispersing element 2 secured to a propane torch 40. The metal front 10 has multiple small holes or openings 20 therethrough.

The heat dispersing element 2 also shows an element guard 42. The heat dispersing element 2 heats to temperatures that require it be safe from contact. The element guard 42 prevents the user from inadvertent contact and keeps them safe from the hot surface of the heat dispersing element 2. The heat dispersing element 2 is attached to a standard propane torch head 40. The torch 40 incorporates a standard tank 50 that contains the propane fuel. The tank 50 is secured within a base 44. Here the base is square and prevents the torch 40 from tipping over during operation. It should be understood that any base configuration that prevents the torch 40 from being knocked over is suitable.

Figure 2:
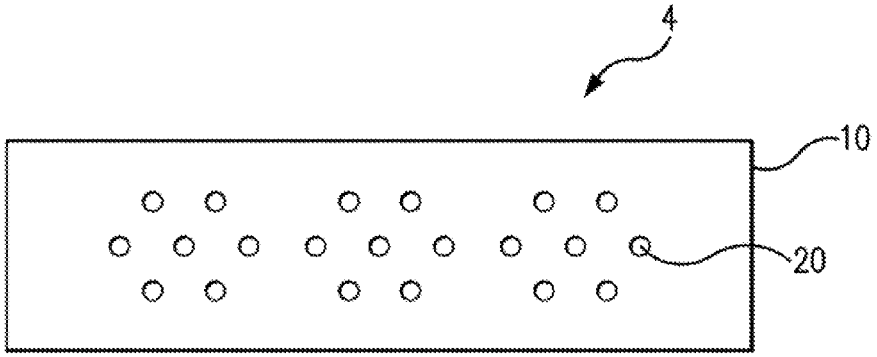
FIG. 2 shows the front of the metal heat dispersing element with a number of small holes.

FIG. 2 shows the metal front 10 of the heat dispersing element 2 with a number of small holes 20. In this embodiment the main housing 4 is made from 1¼ square tubing with a 16 gauge thickness. The front measures 4½ inches in length, center line of the front from one end to the other has nine 5/32 inch holes 20 drilled starting in the center and working out in both directions spaces 5/16 inch apart although these dimensions are not critical and the invention is not so limited.

The $2^{nd}$ and $3^{rd}$ row holes 20 are spaced perpendicular with center row holes 20 but are spaced, for example, 5/16 inch to each side of the center and the holes 20 are drilled in an offset pattern from the canter line holes 20 with the $2^{nd}$ and $3^{rd}$ rows containing only 6 holes per line.

Figure 3:
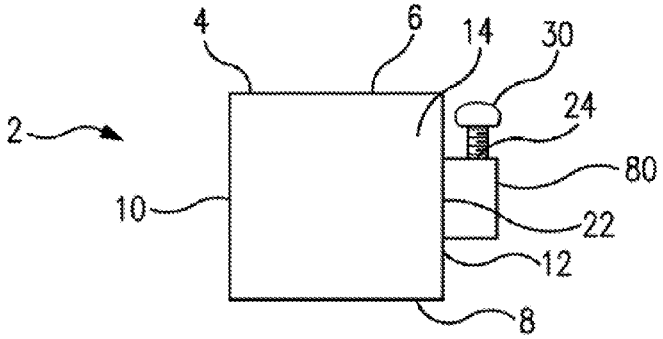
FIG. 3 shows the heat dispersing element from the first end.

FIG. 3 shows the heat dispersing element 2 from the first end 14. The housing 4 has top 6, a flat bottom 8 and a front 10. The housing 4 also has a back 12, a first side 14 and a second side 16 (shown in FIG. 4). There are a plurality of openings 20 therethrough, or small holes, through the front 10. There is an opening 22 therethrough of the back 12. There is another opening 24 therethrough that has a set screw 30 in it. This second opening 80 therethrough accepts the torch head of the propane torch 40 and locks into place with the set screw 30. This is the manner in which the heat dispersing element attaches 2 to the propane torch 40.

Figure 4:
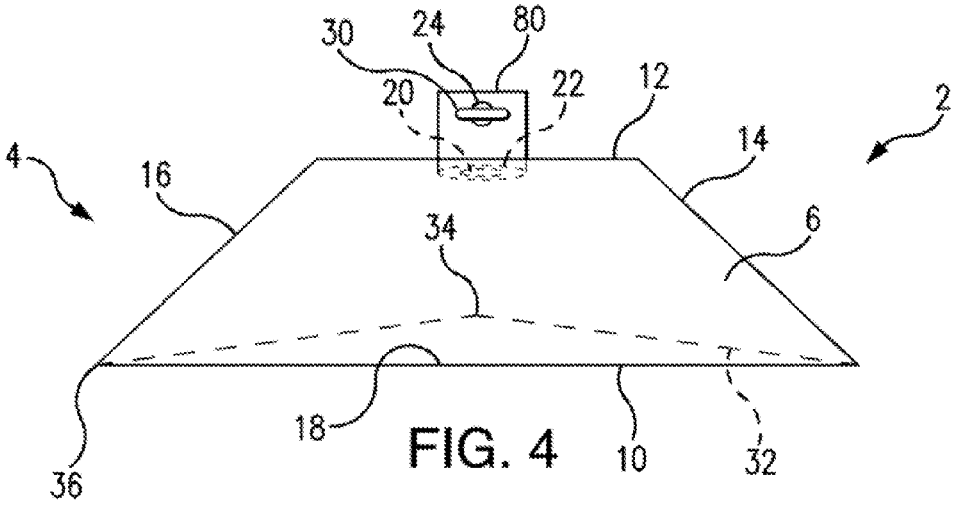
FIG. 4 shows the heat dispersing element from the top.

FIG. 4 shows the heat dispersing element 2 from the top 6. The first side 14 and the second side 16 are cut from the housing 4 in a 45° angle from the front 6 to the back 12. The first side 14 and the second side 16 helps to radiate the heat that is generated from the heat dispersing element 2. Both the first side 14 and the second side 16 help reduce the noise produced by burning the propane fuel because their presence blocks noise that would otherwise escape if they were left open. The front 10 has a series of openings 20 therethrough that radiate heat in a silent manner. Here the inside flat surface 18 is shown with the single plate or burn plate 32 with openings 60 therethrough in phantom.

The opening 22 through the center of the back 12 that is threaded 26 attaches to the main housing 4. This embodiment is threaded, however, it should be understood that this attachment in other embodiments can be welded. The other opening 24 has a set screw 30 to tighten the heat dispersing element 2 to the propane torch 40.

Figure 5:
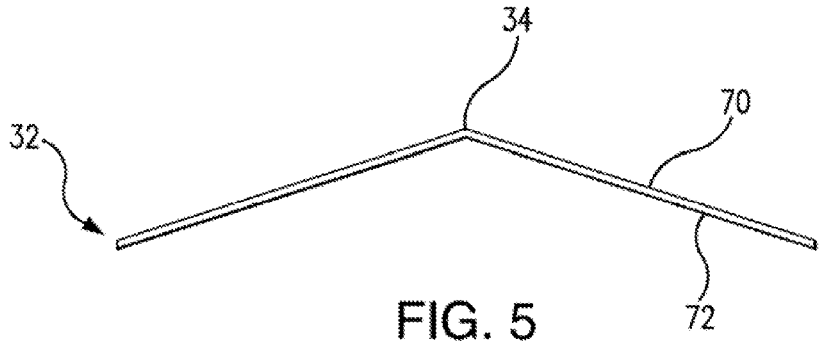
FIG. 5 shows the burn plate from the side.

FIG. 5 shows the burn plate 32 from the side. The burn plate 32 has a front 72 and a back 70. There is also a center point 34 or apex of the burn plate 32. The burn plate 32 attaches to the inside surface 18 of the front 10 of the heat dispersing element 2. The back 70 of the burn plate 32 faces the back 12 of the heat dispersing element 2. The apex or center point 34 of the burn plate 32 points toward the back 12 of the heat dispersing element 2. The apex 34 and pattern openings or openings 60 therethrough of the burn plate 32 and the front 10 of the heat dispersing element work in concert to silence any noise produced when propane fuel burns through the heat dispersing element 2.

Figure 6:
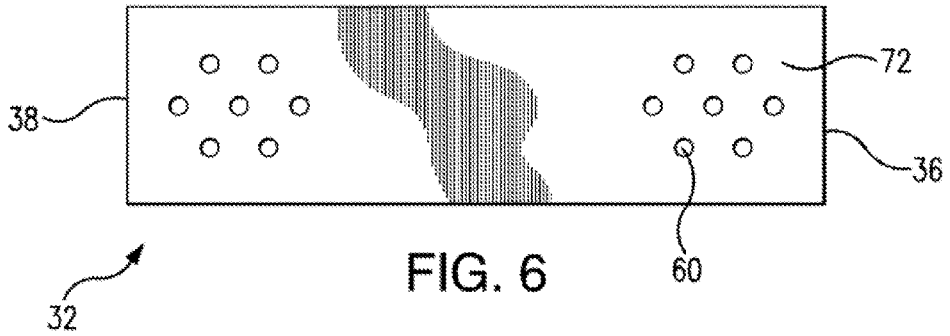
FIG. 6 shows the burn plate from the front.

FIG. 6 shows the burn plate 32 from the front 72. The burn plate 32 has a first end 36 and a second end 38. Also shown are the openings 60.

What is claimed is:

1. A metal heat dispersing element for a propane torch head configured to burn a fuel and produce a flame, the heat dispensing element comprising:

a tapered housing comprising a flat top, a flat bottom, a front plate, a back and two side panels defining an enclosed chamber, wherein the back is shorter in length than the front plate, said front plate having an inside flat surface and a plurality of exhaust ports formed therethrough;

a metal collar mounted to the back having a through bore extending into the enclosed chamber and a threaded opening in a side thereof to accommodate a set screw, wherein the propane torch head is insertable into the enclosed chamber through the through bore and releasably securable to the metal collar with the set screw; and a V-shaped burn plate having two ends fixedly attached to the inside flat surface and a central apex that is bent out of line with the two ends and aligned with the through bore of the metal collar, the burn plate dividing the enclosed chamber into a combustion chamber between the back and a back face of the burn plate and an exhaust chamber between a front face of the burn plate and the front wall, the burn plate having a series of through holes formed therein, wherein the through holes are less in number than the number of exhaust ports in said front plate;

wherein the V-shaped burn plate and the tapered housing work in concert to block light and silence noise produced by the flame from the propane torch head in the combustion chamber.

2. A kit comprising the heat dispersing element as claimed in claim 1, in combination with a base for a propane tank.

3. The heat dispersing element as claimed in claim 1, wherein said heat dispersing element comprises a heat guard surrounding the tapered housing.

4. A heat dispensing element for a propane torch head configured to burn a fuel and produce a flame, the heat dispensing element comprising:

a tapered housing having a front wall, a back wall and a sidewall angling inwardly from the front wall to the back wall to define an enclosed chamber within an inside surface, wherein the front wall has a plurality of exhaust ports formed therethrough and forms a first included angle with the sidewall;

a collar extending from the back wall and having a through bore configured to receive the propane torch head in the enclosed chamber;

a burn plate having a center point out of plane with an outer edge and defining a back face projecting rearwardly from the front wall toward the back wall, wherein the burn plate is attached to the inside surface between the front wall and the back wall such that the burn plate forms a second included angle with the sidewall and divides the enclosed chamber into a combustion chamber between the back wall and the back face and an exhaust chamber between a front face of the burn plate and the front wall; and wherein the second included angle is less than the first included angle such that the rearwardly-projecting burn plate and the tapered housing work in concert to block light and silence noise produced by the flame from the propane torch head in the combustion chamber.

5. The heat dispensing element of claim 4, wherein the burn plate has a plurality of through holes formed therein.

6. The heat dispensing element of claim 5, wherein the through holes are less in number than the exhaust ports in said front plate.

7. The heat dispensing element of claim 4, wherein the tapered housing comprises a trapezoidal prism.

8. The heat dispensing element of claim 4, wherein the collar comprises a threaded hole in a side thereof receiving a threaded set screw for releasably securing the propane torch head to the metal collar.

9. The heat dispensing element of claim 4, wherein the rearwardly-projecting burn plate comprises a V-shaped plate having a central apex aligned with the through bore formed in the collar.

10. The heat dispensing element of claim 4, further comprising a heat guard surrounding the housing in a spaced relationship to prevent inadvertent contact with the housing.

11. A portable heater comprising:

a tank storing a fuel;

a propane torch head secured to an end of the tank, wherein the propane torch head is in fluid communication with the fuel and configured to burn the fuel and produce a flame; and a heat dispensing element including:

a tapered housing having a front wall, a back wall and a sidewall angling inwardly from the front wall to the back wall to define an enclosed chamber within an inside surface, wherein the front wall has a plurality of exhaust ports formed therethrough and forms a first included angle with the sidewall;

a collar extending from the back wall and having a through bore configured to receive the propane torch head in the enclosed chamber;

a burn plate having a center point out of plane with an outer edge and defining a back face projecting rearwardly from the front wall toward the back wall, wherein the burn plate is attached to the inside surface between the front wall and the back wall such that the burn plate forms a second included angle with the sidewall and divides the enclosed chamber into a combustion chamber between the back wall and the back face and an exhaust chamber between a front face of the burn plate and the front wall; and wherein the second included angle is less than the first included angle such that the rearwardly-projecting burn plate and the tapered housing work in concert to block light and silence noise produced by the flame from the propane torch head in the combustion chamber.

12. The portable heater of claim 10, wherein the inwardly-bent burn plate has a plurality of through holes formed therein.

13. The portable heater of claim 12, wherein the through holes are less in number than the exhaust ports in said front plate.

14. The portable heater of claim 10, wherein the housing comprises a trapezoidal prism.

15. The portable heater of claim 10, wherein the collar comprises a threaded hole in a side thereof receiving a threaded set screw for releasably securing the propane torch head to the metal collar.

16. The portable heater of claim 10, wherein the rearwardly-projecting burn plate comprises a V-shaped plate having a central apex aligned with the through bore formed in the collar.

17. The portable heater of claim 10, wherein the heat dissipating element further comprises a heat guard surrounding the housing in a spaced relationship to prevent inadvertent contact with the housing.

18. The portable heater of claim 10, further comprising a base located at an end of the tank opposite the propane torch head.

* * * * *